United States Patent [19]

Muller

[11] 4,347,817

[45] Sep. 7, 1982

[54] IDLE CIRCUIT SHUT-OFF VALVE

[75] Inventor: John E. Muller, Cold Spring, N.Y.

[73] Assignee: Jolenn Energy Products Ltd., Monroe, N.Y.

[21] Appl. No.: 199,943

[22] Filed: Oct. 23, 1980

[51] Int. Cl.[3] ..... F02M 7/12

[52] U.S. Cl. ..... 123/325; 123/333; 123/198 DB; 123/DIG. 11; 261/DIG. 19

[58] Field of Search ..... 123/325, 332, 333, 198 DB, 123/DIG. 11; 261/DIG. 19

[56] References Cited

U.S. PATENT DOCUMENTS

| | | | |
|---|---|---|---|
| 2,359,925 | 10/1944 | Leibing | 123/DIG. 11 |
| 3,080,858 | 3/1963 | Kane, Jr. | 261/DIG. 19 |
| 3,996,908 | 12/1976 | Brown et al. | 123/325 X |
| 3,996,909 | 12/1976 | Fisher | 123/325 X |

*Primary Examiner*—William A. Cuchlinski, Jr.
*Attorney, Agent, or Firm*—Angelo Notaro

[57] ABSTRACT

A method and apparatus for shutting off liquid flow such as fuel in a carburetor during certain sensed conditions, in which an adjustment is provided for further controlling the liquid at times when the liquid is not shut off. When used on a carburetor, idle fuel or injection water is shut off by a needle valve. The needle valve may be retracted to an "on" position. The "on" position is adjustable so as to provide a flow adjustment. Such an arrangement may be provided as an original design feature of a carburetor or may be added to existing carburetor designs, for example, as a kit.

When used as an idle fuel shut-off, the needle valve is adjusted in the "on" position in a manner similar to conventional idle mixture adjustment using idle mixture adjusting screws. Thus, fuel in the idle circuit may be interrupted during engine deceleration, as detected by a high manifold vacuum condition, or during engine shut-off, as detected by an interruption in the engine's ignition circuit.

12 Claims, 3 Drawing Figures

IDLE CIRCUIT SHUT-OFF VALVE

BACKGROUND OF THE INVENTION

This invention is directed to a method and apparatus which reduces fuel consumption under certain engine operating conditions and simultaneously reduces automobile exhaust emissions and, more particularly, to a device which shuts off a carburetor idle fuel passage during deceleration conditions.

A significant emphasis has been made in the past two decades to reduce automobile exhaust emission pollution. While the problem of exhaust pollution has been noted at least as early as 1946 (U.S. Pat. No. 2,466,090), by 1960 automobiles were equipped with PCV devices to redirect crankcase fumes into the combustion chambers. By 1966, the government of California required that exhaust emission pollution from automobiles be reduced to certain levels. Subsequently, the automobile manufacturers have continued to reduce automobile exhaust pollution, primarily as a result of various laws and regulations.

Partially as a result of certain techniques used by the automotive industry in the reduction of exhaust pollution, fuel efficiency has declined during a time when fuel resources were becoming increasingly scarce. Thus, attempts were made to redesign vehicles to obtain increased efficiency. For example as early as the 1971 model year, the largest U.S. automobile manufacturer substantially increased the fuel tank size in most of its larger vehicles. While this did not have any positive effect on efficiency, it nearly halved the frequency of fuel stops required to operate a car with a particular fuel reserve, giving the purchaser the illusion of satisfactory fuel efficiency.

DESCRIPTION OF THE PRIOR ART

As a result of decreased fuel efficiency and the need to further decrease exhaust pollutant emissions, vehicle owners and manufacturers have resorted to various modifications to their vehicles. While some modification, such as installing a switch permitting the driver to turn off a constantly-running air conditioner during winter operation, provided a positive increase in fuel efficiency while reducing or not affecting exhuast emissions, other modification essentially amounted to the actual or effective elimination of pollution-control equipment.

During engine deceleration, when the driver rapidly releases the accelerator, pollution is most likely to occur. While fuel consumption during such conditions is not always a significant factor, frequently-used techniques to correct emissions during deceleration have had the unintended effect of reducing fuel efficiency during other conditions. Usually these techniques have also had the effect of decreasing the ability of a vehicle to decelerate by using engine braking.

U.S. Pat. No. 2,877,998 to Cornelius has proposed a vacuum operated valve arrangement which permits the introduction of air and fuel in excess of that required for normal idling during conditions of high manifold vacuum indicative of engine deceleration. A similar device, called a decel valve was installed on a modification of a Webber carburetor manufactured by the assignee of that patent. While use of the decel valve permitted normal idle operation, the device resulted in an additional mixture feed during deceleration. This resulted in a loss of engine deceleration capability. Thus, in cases where extensive engine braking was required, such as deceleration from high highway speeds and during mountain driving, the device has proven to be quite dangerous. Therefore, it was necessary for the driver to turn off his ignition, thereby promoting exhaust damage when the ignition was turned back on.

Other problems encountered in vehicles, particularly as a result of increased operating temperatures, increased density of fuel charge at idle and increased idle speeds have included a tendency of a vehicle's engine to "after-run" when the ignition is turned off. This is caused by auto-ignition when fuel is being supplied after the engine is turned off. Prior art attempts to alleviate this problem have included the use of an anti dieseling dashpot which reduces throttle setting when the engine is turned off. However, often the driver must take steps to eliminate this problem by either turning off his car while in gear or pumping the accelerator to enrich the mixture being "sucked into" the still-turning engine.

Ericson, U.S. Pat. No. 2,036,205, has described an idle fuel circuit in a carburetor having a valve which responds to excess manifold vacuum. When vacuum exceeds a particular value, a spring force is overcome and air is allowed to bleed into the idle fuel passage, thus effectively cutting off or reducing fuel. A "dead band" operation is described to avoid flutter, but the opening speed of the valve is still dependent upon the rate of an increase in manifold vacuum. Additionally, the Ericson patent not disclose any method for uniformly applying the valve action for more than one idle circuit, such as is found on carburetors having two "primary" venturis. Additionally, no method is shown for the blocking off fuel flow when ignition is turned off in order to prevent after-run.

One problem encountered in the reduction of a fuel supply to an engine is the possibility of burn-out of engine components such as valves when combustion takes place in oxygen-rich conditions. Thus, it is necessary to prevent partial amounts of fuel from entering the combustion chamber during fuel shut-off modes of operation. It is therefore necessary to insure that fuel is rapidly shut-off and rapidly turned-on simultaneously in all idle circuits in carburetors having multiple idle circuits.

Olson, U.S. Pat. No. 2,386,340, describes a carburetor with a solenoid-operated shut-off device which, in response to a manifold vacuum condition shuts off fuel in the idle circuit of a carburetor. The device is built integrally with the carburetor and is formed as a separate restriction in the idle passage. No suggestion is made to shut-off fuel during deceleration.

Walker, U.S. Pat. No. 3,346,243, shows a complex arrangement for cutting off idle in accordance with various engine speed, throttle setting and coolant pressure parameters. While fuel shut-off is shown as being effected by a valve installed through a threaded opening in the idle passage, the device is opened by manifold vacuum but is controlled by other parameters. This has the disadvantage of a slow reaction time as well as the requirement that multiple sensing controls be fitted, particularly at inconvenient locations on the engine. By using manifold vacuum as the operating force, it is difficult for the device to prevent after-run. Furthermore, the control at various engine speeds does not directly relate to deceleration conditions. Therefore, Walker requires a throttle valve to sense when the driver has stopped accelerating. However, since fuel from the idle circuit is primarily drawn from the idle passage by manifold vacuum, rather than by vacuum appearing at a venturi, there is no particular advantage to operating an idle circuit shut-off during normal engine acceleration and cruise conditions.

SUMMARY OF THE INVENTION

It is, accordingly, an object of this invention to provide a method for reducing fuel consumption while reducing exhaust pollutant emissions and enhancing the responsiveness of a vehicle engine by permitting rapid deceleration and rapid engine shut-down when the ignition is turned off. However, it is a further object of this invention to provide a method for shutting off fuel in the idle circuit of a carburetor during deceleration with a shut-off which is non-complex in nature and can be readily installed in existing carburetor designs.

It is, accordingly, a further object of this invention to provide an idle fuel shut-off which does not require further modifications to existing engine configurations. It is a further object of this invention to provide a fuel economy and performance-enhancing device which does not prevent or modify the operation of any existing exhaust emission control devices. However, it is an object of this invention to provide a dual shut-off valve which is capable of rapidly effecting a transition between valve "on" and valve "off" conditions, even when used with multiple idle mixture circuits. It is a further object to provide a device which provides positive fuel shut-off and can be used as an idle mixture adjustment.

It is a further object of this invention to provide a method for positively blocking fuel during deceleration and shut-off of an engine while permitting a rapid transition between fuel shut-off and fuel-on conditions.

It is a further object of this invention to provide a kit which may be added to an existing carburetor which enables the substitution of a fuel shut-off arrangement for the idle mixture adjustment screw of a carburetor.

It is a further object of this invention to provide a fuel shut-off device which, when installed as an exhaust pollutant emission control device, increases fuel efficiency.

Accordingly, in one aspect of this invention, an apparatus is provided for a vehicle having a separate idle fuel circuit wherein a control circuit senses an engine condition. An electromechanical operating solenoid responds to a signal from the control circuit and controls a shut-off valve in the idle fuel circuit.

In a further aspect of this invention, a control circuit sensing an engine condition such as reduced manifold vacuum causes an electromechanical operator to open a shut-off needle valve to an "on" position. The shut-off needle valve uses a needle assembly cooperating with a needle valve seat which forms a part of the engine's idle fuel circuit, and the distance of each needle assembly from the needle valve seat in the "on" position is adjustable, thereby allowing the shut-off valve to serve as an idle fuel mixture adjustment.

In a further aspect of this invention, the electromechanical operator is connected to each needle assembly by a cable linkage.

In another aspect of this invention, a valve needle assembly is provided for controlling the flow of a fluid in a carburetor fluid passage wherein a needle biased toward a valve seat is withdrawn from the valve seat by an electromechanical actuating means to an extent permitted by a stop member. The extent of withdrawal is adjustable. Adjustment of the extent of withdrawal may be accomplished by threading a housing holding the needle away from or toward the valve seat, or by moving a closure member in the housing which abuts against the stop member.

In a further aspect, the needle valve assembly may be provided as a kit. In a further aspect of this invention, a carburetor is provided wherein fuel can be shut off by a needle valve which also serves as an idle fuel adjustment.

In yet a further aspect of this invention, a method for controlling fuel metered through a carburetor is provided wherein a needle valve at each location of idle fuel adjustment is opened or closed by a electromechanical device acting against a biasing means.

DESCRIPTION OF THE PREFERRED EMBODIMENTS

Figure 1:
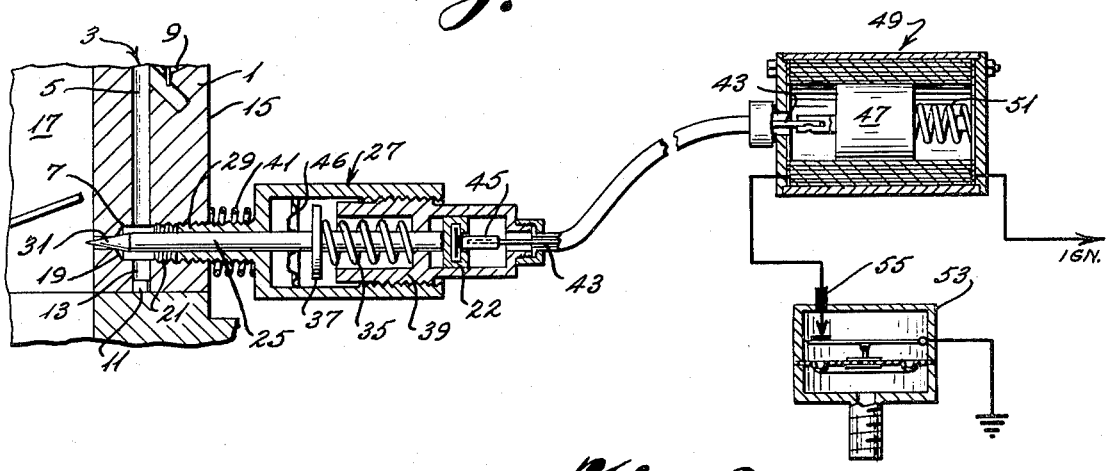
FIG. 1 shows an idle shut-off valve in which a needle valve assembly is connected to an electromagnetic actuator according to one aspect of the invention.

Referring to FIG. 1, a conventional automobile carburetor 1 has an idle fuel circuit 3 therein. The idle fuel circuit usually consists of a vertical bore 5 intercepted by a horizontal bore 7. The vertical bore 5 communicates with a fuel bowl 9. A plug 11 is shown as blocking the bottom end 13 of the vertical bore 5. The horizontal bore extends from an outer surface 15 of the carburetor 1 through to a throttle bore 17.

In prior art carburetor apparatus, an idle adjustment screw (not shown) is threaded into the horizontal bore 7 from the outer surface 15. Such idle adjustment screws are fairly well-known to those skilled in the art and generally consists of a screw portion having a pointed shank portion extending beyond that threaded portion. Such an idle adjustment screw is shown in Rollins, U.S. Pat. No. 3,654,909, which patent is incorporated by reference.

A needle valve seat 19 is formed by the interception of the vertical and horizontal bores 5, 7 at the point of interception furthest from the outer surface 15. By forming a section of the horizontal bore 7 between the outer surface 15 and the vertical bore 5 with a larger diameter than a remaining section of the horizontal bore 7 and by threading the larger diameter section 21, the idle adjustment screw is able to be threaded into the larger diameter section to varying degrees in order to control a bleed valve the idle circuit 3.

In the present invention, a needle member 25 extends from a needle housing 27 toward the needle valve seat 19. The needle housing 27 is provided with a threaded shank 29 which is threaded into the larger diameter section 21 of the horizontal bore 7. The needle member 25 extends through the threaded shank 29.

The needle member 25 has a pointed end 31 which cooperates with the needle valve seat 19 to form a valve restriction. The needle member 25 terminates opposite the pointed end 31, in a catch 22. The needle member 25 is biased toward the needle valve seat 19 by the needle biasing spring 35. A stop member 37 is fixed to the needle member 25 so that a stop member 37 may abut against a closure portion 39 of the needle housing 27. When the stop member 37 abuts against the closure portion 39, the pointed end 31 is separated from the needle valve seat 19, thus providing an open position, as shown in FIG. 2.

Referring again to FIG. 1, the closed position is determined by the relative locations of the needle valve seat 19 and the pointed end 31. However, the open position is determined by the relative locations of the stop member 37 and the closure portion 39. Since the valving in either case is determined by the position of the pointed end 31 with respect to the needle valve seat 19, a change in the distance between the closure portion 39 and the valve seat 19 provides a fuel metering adjustment in the open position. In FIG. 1, the distance between the closure portion 39 and the needle valve seat 19 is changed by threading the threaded shank 29 into and partially out of the larger diameter section 21. In order to prevent the threaded shank 29 from inadvertently moving, an adjustment-holding spring 41 is provided at the threaded shank 29 as is conventional in the art of adjustment screws.

Figure 2:
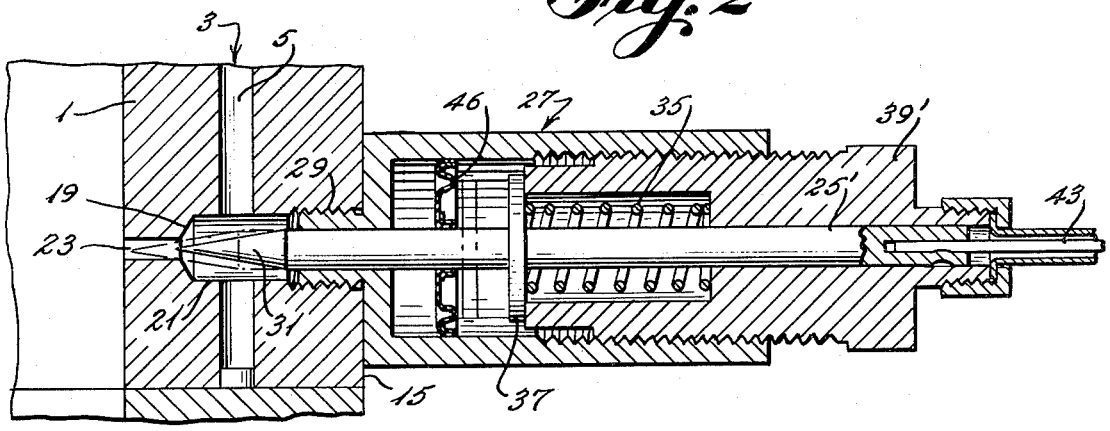
FIG. 2 shows a needle valve assembly according to the invention in which a housing closure member is adjustable in order to provide an idle mixture adjustment.

Referring to FIG. 2, a modified closure portion 39' is threaded into the housing 27. The distance between the modified closure portion 39' and the valve seat 19 is adjusted by threading the modified closure portion 39' into and out of the needle housing 27. For this reason, the adjustment spring 41 may be eliminated and the threaded shank 29 may be threaded into the larger diameter section 21 until the housing 27 abuts against the outer surface 15.

In both FIGS. 1 and 2, a cable is used to withdraw the pointed end 31 away from the valve seat 19 so as to open the idle circuit 3. In the embodiment of FIG. 1, a cable end nipple is provided and the cable end nipple 45 engages catch 22. The connection between the cable end nipple 45 and the catch 22 is slack so that when the cable 43 is slackened, only the needle biasing spring 35 provides force which causes the pointed end 31 to rest against the needle valve seat 19. In the embodiment of FIG. 2, no catch and cable end nipple are provided and the cable 43 is connected directly to a modified needle member 25'.

In order to prevent fuel from leaking past the needle valve member 25 or 25', a seal 46 is provided.

Referring to FIG. 1, the cable 43 terminates at an actuator 47 of an electromagnetic solenoid 49. The electromagnetic solenoid 49 is biased by a solenoid spring 51 towards the cable 43 so as to cause the cable 43 to extend towards the needle member 25. When current is applied to the electromagnetic solenoid 49, the actuator 47 is urged against the solenoid spring 51, withdrawing the cable 43. The withdrawal of the cable pulls the needle member 25 away from the needle valve seat 19 until the stop member 37 abuts against the closure portion 39, thus turning the idle circuit 3 "on" by permitting fuel to flow past the needle valve seat 19.

In order to maintain the idle circuit 3 in an "on" condition under normal idle, the solenoid is connected in a series circuit between the vehicle's ignition switch IGN and a vacuum operated switch 53. The vacuum-operated switch is normally closed, connecting a terminal 55 to ground. The vacuum-operated switch 53 is operated by manifold vacuum so that when manifold vacuum exceeds a predetermined level, the vacuum-operated switch 53 is open thus interrupting current to the electromagnetic solenoid 49. Thus, it can be seen that current to the electromagnetic solenoid 49 is provided only when manifold pressure is above a predetermined level and a vehicle's ignition is on.

The amount of manifold vacuum that causes the vacuum-operated switch 53 to open is selected according to the expected amount of vacuum at idle, the expected amount of vacuum during engine deceleration, as well as the availability of commercially-produced vacuum-operated switches.

Figure 3:
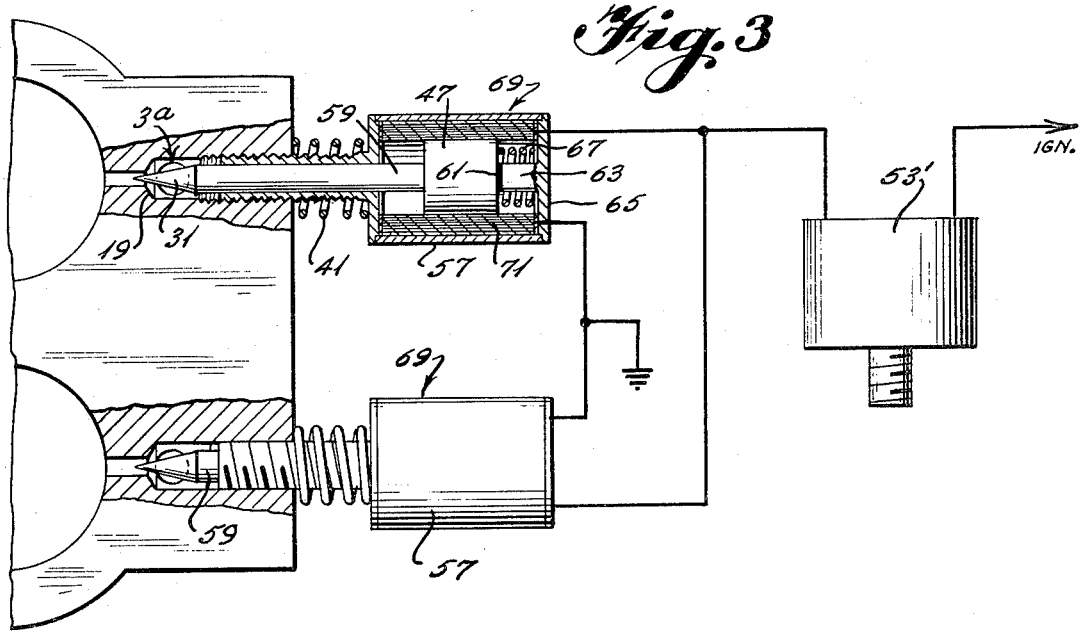
FIG. 3 shows an idle shut-off valve arrangement used in a carburetor having two primary throttle bores each of which has its own needle valve assembly with both needle valve assemblies being simultaneously actuated.

Referring to FIG. 3, the electromagnetic solenoid 49 may be constructed integrally with the needle housing 27 to form a unitary housing 57, two of which are shown in FIG. 3. As can be seen, this arrangement eliminates the requirement for a cable 43. As can be seen in the drawing, a needle member 59 terminates in an actuator 47. The side of the actuator 47 which is furthest from the pointed end 31 of the needle member 59 forms a stop 61. A stop 61 abuts against an extension 63 of a closure portion 65 of the unitary housing 57. A needle-biasing spring 67 biases the needle member 59 and the actuator 47 toward the needle valve seat 19.

In this case, two idle circuits **3*a* and 3*b* are provided and it is necessary to control both idle circuits 3*a*, 3*b* simultaneously, in part because in the usual case complete separation of inlet ports in the engine's intake manifold is not effected. Therefore, two needle assemblies 69 are provided and both needle assemblies 69 are operated by a common vacuum operated switch 53'. In this case, a ground connection is provided at each unitary housing and ignition power is passed through the vacuum operated switch 53' for activation of electromagnetic coils 71 in each unitary housing 57. In order to adjust the relative position of the pointed end 31 with respect to the needle valve seat 19 in the idle "on" position, it is necessary only to follow the normal procedures for adjusting idle mixture. Referring to FIGS. 1 and 3, adjustment is effected by rotating the housing 27 or 57. In FIG. 2, that adjustment is made by rotating the modified closure portion. If, in the embodiment of FIG. 2, the thread spacing between the modified closure portion 39' and the housing 27 is different from the thread spacing of the threaded shank 29**, then that ratio is taken into account in cases where idle adjustment is to be made by rotating an idle adjustment screw a particular number of turns.

In the initial installation of an idle adjustment screw, an initial idle adjustment is made. This initial idle adjustment is made by seating an idle adjustment screw in then backing off or opening the idle adjustment screw a particular number of turns. This procedure would, therefore, be followed using the present invention with the exception that the shut-off feature be set in the "on" mode. This is accomplished by completing a circuit to activate the electromagnetic coils 71. If the device is already installed on a vehicle engine, this completion of the circuit is accomplished by turning the vehicle's ignition switch on or by temporarily connecting the IGN lead to the vehicle's battery.

Referring to FIG. 3, in multiple primary carburetors having plural idle circuits **3*a*, 3*b*, the adjustment of idle fuel mixture for each idle circuit 3*a*, 3*b* is made individually in the manner well-known to those skilled in the art, thus establishing the position of the pointed end 31 of each needle assembly 69 in the "on" position. As previously stated, in the "off" position, the pointed end 31** rests against the needle valve seat, so that the only adjustment required is in the "on" position.

While various arrangements have been shown, further modifications to the invention are possible. For example, referring to FIG. 1, it is possible to connect a second cable (not shown) to the actuator 47 in order to operate two needle valves in a carburetor, such as the carburetor in FIG. 3, having two primary circuits. It is not required that the cable 43 in FIGS. 1 and 2 be directly connected to an actuator, as it is possible to connect the cable 43 to the actuator 47 by a suitable linkage comprising a lever (not shown). Accordingly, various modifications may be made to the present invention without departing from the inventive concepts therein.

While the invention has been described in connection wih an idle fuel circuit, it is also possible to use this invention with other fluid circuits where an adjustable "on" position and a "shut-off" position is desired.

What is claimed is:

1. A valve needle assembly for a carburetor of an engine for a vehicle adapted to control fluid flow through a needle valve seat in a carburetor fluid passage, the carburetor having a bore adapted to receive a conventional idle adjustment screw, the valve needle assembly comprising:

(a) an outer housing adapted to be attached at a first end to an opening of the bore on an outer surface of the carburetor extending into the carburetor to the fluid passage, said housing including a portion received in the bore;

(b) a closure member, the closure member being inserted into a second end of the outer housing;

(c) a needle member, the needle member passing through the outer housing at the first end of the housing and having a needle end adapted to be passed through the needle valve seat to restrict passage of fluid therethrough;

(d) a needle biasing means, the needle biasing means biasing the needle member toward the needle valve seat;

(e) a stop member fixed to the needle member, the stop member limiting travel of the needle member away from the needle valve seat, the stop member being an enlarged portion on the needle member and wherein the stop member limits said travel by abutting against the closure member;

(f) electromechanical actuating means connected to the needle member, the electromechanical actuating means operating to withdraw the needle member away from the needle valve seat to the extent permitted by the stop member;

(g) an adjustment means, the adjustment means controlling the distance that the needle member is from the needle valve seat when the stop member has limited the travel of the needle member, wherein the first end of the housing is attached to the opening by threads, and the threads form the adjustment means.

2. A valve needle assembly for a carburetor of an engine for a vehicle adapted to control fluid flow through a needle valve seat in a carburetor fluid passage, the carburetor having a bore adapted to receive a conventional idle adjustment screw, the valve needle assembly comprising:

(a) an outer housing attached at a first end to an opening of the bore on an outer surface of the carburetor extending into the carburetor to the fluid passage, said housing including a portion received in the bore;

(b) a closure member, the closure member being inserted into a second end of the outer housing;

(c) a needle member, the needle member passing through the outer housing at the first end of the housing and having a needle end adapted to be passed through a needle valve seat to restrict passage of fluid therethrough;

(d) a needle biasing means, the needle biasing means biasing the needle member toward the needle valve seat;

(e) a stop member fixed to the needle member, the stop member limiting travel of the needle member away from the needle valve seat, the stop member being an enlarged portion on the needle member and wherein the stop member limits said travel by abutting against the closure member;

(f) electromechanical actuating means connected to the needle member, the electromechanical actuating means operating to withdraw the needle member away from the needle valve seat to the extent permitted by the stop member;

(g) an adjustment means, the adjustment means controlling the distance that the needle member is from the needle valve seat when the stop member has limited the travel of the needle member, wherein the adjustment means comprises threads connecting the closure member to the outer housing.

3. The needle valve assembly, as set forth in claim 1 or 2, the carburetor being of the type having a separate idle fuel circuit through which fuel is allowed to flow to provide a substantial quantity of the fuel used by the engine during idle, having an engine air intake opening and having means for throttling the engine air intake opening, further comprising at least one idle passage through which fuel is admitted into the throttled air intake opening; wherein the needle valve seat forms a part of each passage; and wherein the needle biasing means is operative to seat the needle member against the needle valve seat when the engine is switched "off" to prevent engine after-run.

4. The valve needle assembly of claim 3 wherein the engine condition sensed indicates a requirement that the idle fuel circuit be open to the passage of fuel.

5. The valve needle assembly of claim 4 wherein the engine condition sensed is a manifold pressure above a certain value with the vehicle's ignition switch "on," thereby permitting the idle fuel supply to be blocked during high manifold vacuum to increase engine braking, fuel economy and decrease exhaust pollution, and permitting the fuel supply to be blocked when the ignition is switched "off" to prevent engine after-run.

6. The valve needle assembly of claim 5 wherein the assembly is threaded into the carburetor through a threaded opening to each idle passage and the distance of the needle member from its respective valve seat in the "on" position is adjusted by turning the needle assembly along the threads.

7. The needle valve assembly, as set forth in claim 3, further comprising means for sensing an engine condition and generating a control signal indicative of the sensed engine condition; the electromechanical actuating means being operatively connected to the sensing means; and the electromechanical actuating means being operative to pull the needle member away from the needle valve seat when the engine is switched "on".

8. The needle valve assembly, as set forth in claim 7, wherein the electromechanical actuating means comprises a solenoid and a cable linkage, and the solenoid is mechanically attached to the needle member by the cable linkage.

9. The needle valve assembly, as set forth in claim 7, wherein the electromechanical actuating means comprises a solenoid and a cable linkage and the solenoid is both integrally and directly attached to the needle member by the cable linkage.

10. The needle valve assembly of claim 1 or 2 wherein the valve needle assembly is provided as a kit to be placed on the vehicle carburetor permitting the valve needle assembly to shut-off fuel in the fuel passage when an engine condition is detected and to shut-off fuel in the fuel passage when the engine is turned off.

11. The needle valve assembly as set forth in claim 1 or 2 wherein the needle member extends through the closure member.

12. The needle valve assembly of claim 11 wherein the needle member is connected to the actuating means by a cable linkage, a cable biasing means is provided to bias linkage the cable against the electromechanical actuating means and a seal is provided on the needle member to prevent fuel from leaking from the valve needle assembly where the needle member passes through the closure member.

* * * * *